US009416680B2

(12) United States Patent
Homeyer

(10) Patent No.: US 9,416,680 B2
(45) Date of Patent: Aug. 16, 2016

(54) OIL SUPPLY SYSTEM FOR A PROPELLER TURBINE ENGINE

(71) Applicant: Rolls-Royce Deutschland Ltd & Co KG, Blankenfelde-Mahlow (DE)

(72) Inventor: Christian Homeyer, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 663 days.

(21) Appl. No.: 13/886,721

(22) Filed: May 3, 2013

(65) Prior Publication Data

US 2013/0309091 A1 Nov. 21, 2013

(30) Foreign Application Priority Data

May 4, 2012 (DE) ..... 10 2012 207 447

(51) Int. Cl.
*F01D 25/18* (2006.01)
*F01D 25/20* (2006.01)

(52) U.S. Cl.
CPC ..... *F01D 25/18* (2013.01); *F01D 25/20* (2013.01); *F05D 2220/323* (2013.01)

(58) Field of Classification Search
CPC ... F01D 25/18; F01D 25/20; F05D 2220/323; F05D 2260/75; F05D 2260/76; F05D 2270/64
See application file for complete search history.

(56) References Cited

U.S. PATENT DOCUMENTS

| | | | | |
|---|---|---|---|---|
| 3,097,700 | A * | 7/1963 | Szydlowski | B64C 11/305 416/28 |
| 4,097,189 | A * | 6/1978 | Harlamert | B64C 11/38 416/154 |
| 6,729,130 | B1 * | 5/2004 | Lilleland | E21B 33/0355 60/413 |
| 7,118,336 | B2 * | 10/2006 | Waddleton | B64C 11/38 184/6.12 |
| 2005/0135929 | A1 | 6/2005 | Waddleton | |

FOREIGN PATENT DOCUMENTS

| | | |
|---|---|---|
| GB | 550533 | 1/1943 |
| GB | 1041353 | 9/1966 |

* cited by examiner

*Primary Examiner* — Richard Edgar
*Assistant Examiner* — Brian P Wolcott
(74) *Attorney, Agent, or Firm* — Timothy J. Klima; Shuttleworth & Ingersoll, PLC

(57) ABSTRACT

An oil supply system for a propeller turbine engine including a propeller, a propeller gearbox connected to the propeller and a propeller adjusting device for altering the pitch angle of the propeller blades. The system includes an oil circuit and a propeller main pump for supplying the propeller gearbox and a propeller high-pressure pump supplying the propeller adjusting device with oil. The system includes an oil accumulator for providing, in the event of an undersupply of oil by the propeller main pump, oil contained in the oil accumulator to the inlet of the propeller high-pressure pump such that the pump inlet pressure at the inlet of the propeller high-pressure pump does not fall short of a certain minimum value. The oil accumulator is incorporated into the inflow to the propeller high-pressure pump to be continuously supplied and charged with oil of the propeller main pump.

16 Claims, 1 Drawing Sheet

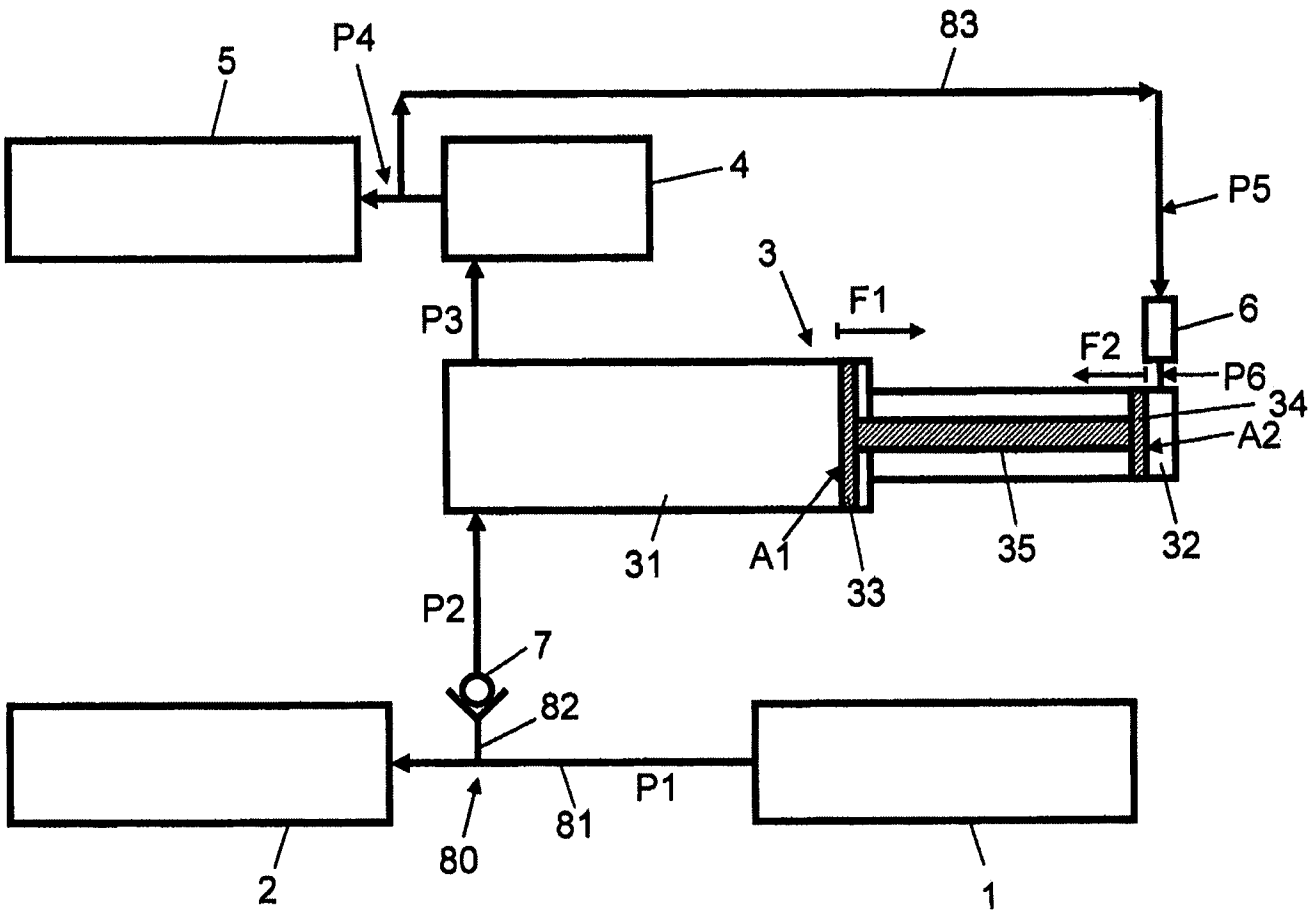
P5
6
P6
34
A2
32
F2
35
83
F1
33
3
A1
4
31
P1
81
7
82
80
P3
P2
P4
5
2
1

OIL SUPPLY SYSTEM FOR A PROPELLER TURBINE ENGINE

This application claims priority to German Patent Application DE102012207447.3 filed May 4, 2012, the entirety of which is incorporated by reference herein.

This invention relates to an oil supply system for a propeller turbine engine.

A propeller turbine engine (i.e. a turboprop engine, a propfan engine or a propeller engine) consists substantially of a turbomachine and at least one propeller driven via a propeller gearbox and connected to a propeller adjusting device for altering the pitch angle of the propeller blades. Propeller engines are usually equipped with two oil circuits separate from one another. Oil is supplied to the turbomachine via a first oil circuit. An oil tank, a propeller main pump—as a rule coupled to the propeller shaft—as the oil conveying pump, if necessary an oil filter and an oil cooler, and the propeller gearbox supplied with part of the conveyed oil quantity, are incorporated into a second oil circuit intended for supplying oil to the propeller system. Furthermore, a propeller high-pressure pump connected to the propeller adjusting device and supplied with a further part of the supplied oil quantity is also incorporated into the second oil circuit in order to generate the pressure required to adjust the propeller blades.

The previously described oil supply system is disadvantageous to the extent that in the oil circuit for supplying oil to the propeller system, under certain conditions the oil supply to the propeller high-pressure pump and hence the initial pressure of the oil at the propeller high-pressure pump may be too low, so that the propeller adjusting device is undersupplied and its function of achieving a required pitch angle of the propeller blades is restricted. Furthermore, damage to the high-pressure pump can also occur in this case.

An insufficient oil flow and a correspondingly low initial pressure of the oil at the propeller high-pressure pump can result from the propeller main pump coupled to the propeller shaft no longer being supplied with oil from the oil tank when gravitational acceleration is neutralized or negative, since the oil recedes from the oil tank outlet due to the abruptly reversing gravitational acceleration. This can have the result that only a low or intermittent control pressure is available which is insufficient for the requirements of adjusting the propeller blades.

Furthermore, in the event of failure of the oil supply the propeller main pump aspirates air from the oil tank and conveys it in the direction of the propeller adjusting device. When this air reaches the propeller adjusting device, the propeller control pressure collapses and the propeller adjusting device commands the locking of the propeller, which can therefore no longer be adjusted and thus prevents proper engine power regulation.

The object underlying the present invention is accordingly to provide an oil supply system for a propeller turbine engine which ensures the functioning of the propeller adjusting system even in the event of an undersupply of oil.

It is a particular object of the present invention to provide solution to the above problems by an oil supply system in accordance with the features described herein. Embodiments of the invention will become apparent from the present description.

Accordingly, it is provided that an oil accumulator is used which, in the event of an undersupply of oil by the propeller main pump, provides oil contained in the oil accumulator to the inlet of a propeller high-pressure pump associated with the propeller adjusting device such that the pump inlet pressure at the inlet of the propeller high-pressure pump does not fall short of a certain minimum value. Here the oil accumulator is incorporated into the inflow to the propeller high-pressure pump such that it is continuously supplied and charged with oil of the propeller main pump.

The solution in accordance with the invention is thus based on the idea of incorporating an oil accumulator into the oil circuit of the oil supply system which, in the event of an undersupply of oil during a fixed or specified period, which is for example an oil interruption period during which gravitational acceleration is neutralized or negative for 20 seconds, ensures a minimum pump inlet pressure at the propeller high-pressure pump and thereby maintains the functioning of the propeller adjusting system such that locking of the propeller is prevented and proper engine regulation is assured. The oil supply of the propeller adjusting system is thus assured by the oil accumulator in the event of an undersupply of oil.

The oil accumulator is here incorporated into the inflow to the propeller high-pressure pump such that it is permanently supplied and charged with oil of the propeller main pump. The oil accumulator is therefore charged in normal operation with oil of the main pump without an additional pumping device being required.

In accordance with an embodiment of the invention, the oil accumulator is connected using oil lines and valves such that during regular operation of the oil supply system it is automatically charged with oil and in the event of an undersupply of oil provides the oil to the propeller high-pressure pump at a certain volumetric flow and pressure. In normal operation, i.e. with a steady oil supply by the propeller main pump and fully charged accumulator, the oil is passed directly to the propeller high-pressure pump, which then conveys the oil to the propeller adjusting system.

In accordance with a further embodiment of the invention, the oil accumulator is designed such that it has no electrical driving means and is controlled exclusively by the pressures applied to it.

In accordance with a further exemplary embodiment, a valve is incorporated into the inflow to the oil accumulator and closes automatically in the event of oil being dispensed by the oil accumulator, so that a return flow of oil from the oil accumulator into the main conveying line of the propeller main pump is prevented. A valve of this type is for example designed as a non-return valve. As soon as the oil pressure provided by the oil accumulator is greater than the oil pressure provided by the propeller main pump, the non-return valve closes automatically. This ensures that oil can only flow in the direction of the propeller high-pressure pump.

In accordance with a further embodiment, the oil circuit of the oil supply system in accordance with the invention has a main conveying line to the propeller gearbox, into which is fed oil from the propeller main pump. In addition, a secondary conveying line is present that branches off from the main conveying line and to which first the oil accumulator and then the propeller high-pressure pump are connected one behind the other. The oil accumulator, the propeller high-pressure pump and the propeller adjusting device supplied with oil from the propeller high-pressure pump are thus located in a separate conveying branch of the oil supply system. The valve mentioned for prevention of a return flow of oil into the main conveying line is here arranged directly behind the branch of the secondary conveying line from the main conveying line and inside the inflow to the oil accumulator.

The oil accumulator is, in one embodiment of the invention, designed such that it has two hydraulically separate oil pressure chambers referred to as first and second oil pressure chambers. The first oil pressure chamber contains the quantity of oil provided in the event of an undersupply of oil of the propeller high-pressure pump. In normal operation, the first oil pressure chamber is filled with oil. The second oil pressure chamber is subjected to a pressure such that in the event of an undersupply of oil, the oil is forced out of the first oil pressure chamber.

The manner of connection between the two oil pressure chambers of the oil accumulator can generally speaking be as required, as long as the stated function is achieved. In accordance with a design variant, a first piston is arranged in the first oil pressure chamber and a second piston in the second oil pressure chamber, said pistons being connected to one another by a piston rod. When the piston is moved in one direction the one oil pressure chamber dispenses oil and the other oil pressure chamber is filled with oil. When the piston rod is moved in the other direction, the situation is reversed. Here the first oil pressure chamber in accordance with one design variant has a greater volume than the second oil pressure chamber, since only the first oil pressure chamber provides oil in the event of an undersupply of oil.

The first piston has a first piston area and the second piston has a second piston area. The first piston area and the second piston area are in a certain ratio to one another. This ratio and the inlet pressure applied at the second oil pressure chamber are dimensioned such that the force acting on the second piston area exceeds the force acting on the first piston area when the minimum pump inlet pressure is not attained at the inlet of the propeller high-pressure pump.

For this case, i.e. when there is an undersupply of oil, the first piston is moved by the piston rod in the first oil pressure chamber such that oil is dispensed by the first oil pressure chamber and provided to the propeller high-pressure pump for maintaining the minimum pump inlet pressure.

Furthermore, it is provided in one embodiment that the outlet of the propeller high-pressure pump is connected to the second oil pressure chamber, while the first oil pressure chamber is connected to the inlet of the propeller high-pressure pump. A closed oil circuit is however not provided here, since the two chambers of the oil accumulator are hydraulically separated from one another.

In one embodiment, it is provided that the outlet of the propeller high-pressure pump is connected to the second oil pressure chamber of the oil accumulator with an oil pressure reducing valve connected between them. This valve is set to a certain, constant pressure for controlling the oil accumulator. This constant pressure, referred to as control pressure, is set here such that the oil accumulator does not respond (i.e.: dose not dispense oil) until the oil pressure in the first oil pressure chamber drops below a predetermined level.

The oil accumulator is furthermore designed such that in the case of normal oil supply of the propeller main pump, the piston force is, due to the oil pressure on the first piston of the first oil pressure chamber, greater than the piston force on the second piston which provides the oil pressure in the second chamber. In normal operation, the first piston is thus moved such that the first oil pressure chamber is filled to maximum with oil.

The oil volume of the first oil pressure chamber is preferably dimensioned sufficiently to ensure the oil supply of the propeller adjusting device for a previously fixed period of time. This fixed period of time is for example up to 20 or up to 40 seconds, corresponding to a gravitational acceleration which is neutralized or negative for a maximum of 20 or 40 seconds.

In accordance with an embodiment of the invention, it can be provided that the oil supply system has a further oil circuit for supplying oil to a turbomachine of the propeller turbine engine. A further oil circuit of this type is preferably separated from the oil circuit for supplying the propeller system.

The present invention is described in greater detail in the following with reference to the FIGURE of the accompanying drawing showing an exemplary embodiment.

The sole FIGURE shows a block diagram of an exemplary embodiment of an oil supply system for a propeller turbine engine.

The oil supply system shown in the FIGURE is used to supply oil to a propeller gearbox 2 and to a propeller adjusting device 5. The propeller gearbox 2 is connected to a propeller (not shown) of a propeller turbine engine and is driven for example by a drive shaft (not shown) of a turbomachine (not shown) of the propeller turbine engine. The propeller adjusting device 5 is used for setting the pitch angle of the propeller blades of the propeller.

For oil supply to the propeller gearbox 2 and to the propeller adjusting device 5, the oil supply system includes an oil circuit into which are incorporated a propeller main pump 1, the propeller gearbox 2, an oil accumulator 3, a propeller high-pressure pump 4 and the propeller adjusting device 5. Further components provided are an oil pressure reducing valve 6 and a non-return valve 7.

It is pointed out that the oil supply system may have, besides the stated oil circuit, a further oil circuit for oil supply to the turbomachine mentioned of the propeller turbine engine. A further oil circuit of this type is achieved using a separate oil circuit (not shown), where the two oil circuits can have a common oil tank.

The propeller main pump 1 conveys oil of an oil tank (not shown) and provides the oil at a pressure P1 to a main conveying line 81 which supplies the oil to the propeller gearbox 2. The main conveying line 81 has a branch 80 at which a secondary conveying line 82 branches off from the main conveying line 81. Oil is conveyed via the non-return valve 7 and the oil accumulator 3 to the propeller high-pressure pump 4 via the secondary conveying line 82. An inlet pressure P2 is applied here to the oil accumulator 3 and an inlet pressure P3 to the propeller high-pressure pump 4. The pressures P2 and P3 are identical apart from a certain pressure drop over the length of the secondary conveying line 82. In normal operation, when the oil accumulator 3 is not providing oil for supplying the propeller high-pressure pump 4, the pressures P2 and P3—once again apart from a certain pressure drop over the length of the secondary conveying line 82—are furthermore substantially identical to the pressure P1.

The pressure P3 is set here such that a minimum pump inlet pressure is applied at the inlet of the propeller high-pressure pump 4, which is for example 240 kPa. Such a minimum pump inlet pressure is required for a sufficient oil supply of the propeller high-pressure pump 4.

The propeller high-pressure pump 4 provides at its outlet a pressure P4 for the propeller adjusting device 5 which is considerably above the pressure P3, and for example exceeds it by a factor of 50 to 150.

The oil accumulator 3 has two cylindrically shaped oil pressure chambers 31, 32, where the one oil pressure chamber 31 has a greater volume capacity than the other oil pressure chamber 32. Accordingly, the one oil pressure chamber 31 is referred to hereinafter also as the main oil pressure chamber and the other oil pressure chamber 32 hereinafter also as the secondary oil pressure chamber.

The main oil pressure chamber 31 contains a first piston 33. The secondary oil pressure chamber 32 contains a second piston 34. The two pistons 33, 34 are connected to one another by a piston rod 35 arranged displaceable such that the two pistons 33, 34 and the piston rod 35 can be moved in the longitudinal direction. The first piston 33 has a piston area A1 and the second piston 34 a piston area A2, where the first piston area A1 is larger than the second piston area A2.

The positions of the two pistons 33, 34 in the two chambers 31, 32 depend on whether the force F1 acting on the first piston 33 or the force F2 acting on the second piston 34 is greater. This is set forth below in detail.

The outlet of the propeller high-pressure pump 4 is connected to the secondary oil pressure chamber 32 via a further conveying line 83, with the oil pressure reducing valve 6 connected between them. A pressure P5 is applied at the inlet of the oil pressure reducing valve 6 and is, apart from the pressure drop over the length of the further conveying line 83, identical to the pressure P4 and accordingly also very high. At the outlet of the oil pressure reducing valve 6 and hence at the inlet of the secondary oil pressure chamber 32, a correspondingly reduced inlet pressure P6 applies. The pressure P6 is for example lower than the pressure P5 by a factor of 10-15.

The aim of the described oil supply system is to keep the inlet pressure P3 at the propeller high-pressure pump 4 always above the minimum pump inlet pressure which is necessary for a sufficient oil supply of the propeller high-pressure pump 4. Maintaining in this way a minimum pump inlet pressure should in particular also be assured in the event that an undersupply of oil by the propeller main pump 1 occurs, for example since the aircraft is flying a parabola. For this case, the propeller main pump 1 cannot take oil out of the oil tank and the provided pressure P1, P2, P3 drops, for example to 100 kPa or even to zero.

To understand the oil supply system in accordance with the invention, first normal operation is considered, i.e. the situation in which the propeller main pump 1 provides a sufficient volumetric flow and inlet pressure P3 which is above the minimum pump inlet pressure of the propeller high-pressure pump 4. For this case, P3 (which is identical to P2 and P1 apart from a possible pressure drop over the corresponding length of the conveying line) is therefore greater than the minimum pump inlet pressure.

At the same time, in normal operation the ratio of the two piston areas A1/A2 is dimensioned and the inlet pressure P6 at the secondary oil pressure chamber 32 is selected such that the force F1 acting on the piston area A1 is greater than the force F2 acting on the piston area A2. It is known that p=F/A, where p refers to the pressure and F to the amount of a force normally applied to an area A. Accordingly, in normal operation the following applies:

$$F1=P2\times A1>F2=P6\times A2.$$

Due to the greater force F1, the piston 33 in the main oil pressure chamber 31 is moved to the right and the main oil pressure chamber 31 is filled to maximum with oil. Accordingly, the piston 34 of the secondary oil pressure chamber 32 is moved such that the secondary oil pressure chamber 32 is filled only to minimum with oil, where however a residual volume filled with oil still remains.

If an undersupply of oil occurs, the pressure P3 drops below the minimum pump inlet pressure of the propeller high-pressure pump 4, so that there is a risk of an undersupply and functional restriction of the propeller adjusting device 5. Now the ratio of the piston areas A1/A2 and the inlet pressure P6 of the secondary oil pressure chamber 32 are dimensioned such that with a drop of the pressure P3 (which is substantially equal to the pressure P2), the force F2 acting on the piston area A2 exceeds the force F1 acting on the piston area A1, so that the piston 34 moves the piston 33 inside the main oil pressure chamber 31 to the left via the piston rod 35, and in so doing oil is dispensed by the oil accumulator 3.

This is achieved with the generation of a pressure at the inlet of the propeller high-pressure pump 4 which is at least equal to the minimum pump inlet pressure of the propeller high-pressure pump 4. Dependable further operation of the propeller high-pressure pump and of the propeller adjusting device 5 is assured. Since the pressure provided by the oil accumulator 3 is now higher than the pressure P1 of the propeller main pump, the non-return valve 7 furthermore closes automatically, so that it is dependably prevented that a return flow of oil can occur from the oil accumulator 3 into the main conveying line 81 of the propeller main pump 1.

When the pressure P3 drops below the minimum pump inlet pressure, the valve 7 thus closes, so that the pressure P1 is then lower than the pressures P2 and P3, since these two pressures P2 and P3 are then maintained by the oil accumulator 3. P1, P2 and P3 are thus identical only in normal operation.

In oil accumulator operation, when the propeller main pump 1 provides a faulty volumetric flow and pressure P3, the following thus applies for the forces F1, F2 at the piston areas A1, A2:

$$F1=P3\times A1<F2=P6\times A2.$$

The piston 33 thus moves from right to left and thereby moves oil to the propeller high-pressure pump 4, where the pressure P3—now provided by the oil accumulator 3—is greater than the minimum pump inlet pressure of the propeller high-pressure pump 4. The oil supply of the propeller high-pressure pump 4 is now completely assured by the oil accumulator 3.

When the undersupply of oil by the propeller main pump 1 has ended, then the situation reverts to normal operation again, with the main oil pressure chamber 31 being refilled with oil as the piston 33 moves to the right.

To ensure that the inlet pressure P3 is always equal to or greater than the minimum pump inlet pressure of the propeller high-pressure pump 4, the oil accumulator 3 and the oil pressure reducing valve 6 are designed such that at a pressure P3 slightly above the minimum pump inlet pressure (where P3 is at least approximately equal to P2), the following applies:

$$F1=P3\times A1=F2=P6\times A2.$$

When the minimum pump inlet pressure is for example 240 kPa, the equality of F1 and F2 applies for example at a pressure slightly above this, of P3=250 kPa. This ensures that F2 is greater than F1 as soon as the pressure P3 drops below the design point, and accordingly the oil accumulator 3 then provides a volumetric flow and oil pressure P3.

The oil accumulator 3 is thus dimensioned such that the forces F1 and F2 slightly above the minimum pump inlet pressure (250 kPa in the example considered) neutralize each other: F1=F2. If the pressure P1 is less than 250 kPa, the piston rod 35 automatically moves to the left, since F1 is then less than F2.

The oil tries in this case to flow in the direction of the propeller gearbox 2 too, due to the altered pressure level, since it always tries to flow in the direction of the lowest pressure level. This is however prevented by the closing of the non-return valve 7 that reacts to the flow reversal.

The invention is not restricted in its design to the exemplary embodiment set forth above, which must be understood only as an example. For instance, the oil accumulator can be designed in another way than that shown, for example have oil pressure chambers and pistons designed in a different way.

What is claimed is:

1. An oil supply system for a propeller turbine engine, including a propeller with propeller blades, a propeller gearbox connected to the propeller and a propeller adjusting device for altering a pitch angle of the propeller blades, comprising:

a propeller main pump for supplying oil to the propeller gearbox, an oil circuit connecting the propeller main pump to the propeller gearbox and the propeller adjusting device for routing oil from the propeller main pump to the propeller gearbox and the propeller adjusting device, a propeller high-pressure pump positioned in the oil circuit to receive oil from the propeller main pump, further pressurize the oil from the propeller main pump and provide the further pressurized oil to the propeller adjusting device, an oil accumulator including a main oil pressure chamber having a variable volume positioned in the oil circuit between the propeller main pump and the propeller high-pressure pump to be supplied with oil from the propeller main pump; the main oil pressure chamber expanding in volume to receive and accumulate oil from the propeller main pump during normal supply of oil by the propeller main pump to the propeller high-pressure pump; the main oil pressure chamber contracting in volume to supply the accumulated oil to the propeller high-pressure pump during an undersupply of oil by the propeller main pump to the propeller high-pressure pump to prevent an oil pressure at an inlet of the propeller high-pressure pump from decreasing beyond a preset.

2. The oil supply system in accordance with claim 1, the variable volume of the main oil pressure chamber is controlled exclusively by pressures applied the main oil pressure chamber.

3. The oil supply system in accordance with claim 1, and further comprising a one-way valve positioned in the oil circuit between the propeller main pump and the main oil pressure chamber for closing automatically when the accumulated oil is being supplied to the propeller high-pressure pump to prevent a return flow of oil from the main oil pressure chamber to the propeller main pump.

4. The oil supply system in accordance with claim 3, wherein the oil circuit includes a main conveying line connecting the propeller gearbox to the propeller main pump, and a secondary conveying line that branches off from the main conveying line connecting the propeller main pump to the main oil pressure chamber and the propeller high-pressure pump.

5. The oil supply system in accordance with claim 4, wherein the one-way valve is positioned in the secondary conveying line between the main conveying line and the main oil pressure chamber.

6. The oil supply system in accordance with claim 1, wherein the oil accumulator includes a secondary oil pressure chamber having a variable volume positioned in the oil circuit and mechanically connected to the main oil pressure chamber such that during the undersupply of oil the secondary oil pressure chamber is subjected to a pressure from the oil circuit to contract the main oil pressure chamber to supply the accumulated oil to the propeller high-pressure oil pump.

7. The oil supply system in accordance with claim 6, and further comprising:

a first piston arranged in the main oil pressure chamber for varying the volume of the main oil pressure chamber, a second piston arranged in the secondary oil pressure chamber for varying the volume of the secondary oil pressure chamber, a piston rod connecting the first and second pistons to one another, with one of the oil pressure chambers dispensing oil and the other of the oil pressure chambers being filled with oil, when the piston rod is moved.

8. The oil supply system in accordance with claim 7, wherein the first piston has a first piston area and the second piston has a second piston area, with the first and the second piston areas being in a certain ratio to one another and an inlet pressure applied at the secondary oil pressure chamber being dimensioned such that a force acting on the second piston area exceeds a force acting on the first piston area when the preset minimum value of the oil pressure at the inlet of the propeller high-pressure pump is not attained.

9. The oil supply system in accordance with claim 8, wherein the force acting on the second piston area is equal to the force acting on the first piston area, when the inlet pressure at the propeller high-pressure pump slightly exceeds the preset minimum value of the oil pressure at the inlet of the propeller high-pressure pump.

10. The oil supply system in accordance with claim 7, wherein the main oil pressure chamber is connected to an inlet of the propeller high-pressure pump and the secondary oil pressure chamber is connected to an outlet of the propeller high-pressure pump.

11. The oil supply system in accordance with claim 10, and further comprising an oil pressure reducing valve positioned in the oil circuit between the outlet of the propeller high-pressure pump and the secondary oil pressure chamber.

12. The oil supply system in accordance with claim 10, wherein the main oil pressure chamber has a greater volume than the secondary oil pressure chamber.

13. The oil supply system in accordance with claim 1, wherein the preset minimum value of the oil pressure at the inlet of the propeller high-pressure pump ranges from 200 kPa to 300 kPa.

14. The oil supply system in accordance with claim 1, and further comprising a further oil circuit for supplying oil to a turbomachine of the propeller turbine engine.

15. The oil supply system in accordance with claim 12, wherein an oil volume of the main oil pressure chamber is dimensioned to ensure the oil supply to the propeller adjusting device for a fixed period of time.

16. The oil supply system in accordance with claim 1, wherein the preset minimum value of the oil pressure at the inlet of the propeller high-pressure pump ranges from 200 kPa to about 240 kPa.

* * * * *